US011211712B1

(12) United States Patent
Stepanenko et al.

(10) Patent No.: US 11,211,712 B1
(45) Date of Patent: Dec. 28, 2021

(54) COMPACT INTEGRATED GNSS-UHF ANTENNA SYSTEM

(71) Applicant: Topcon Positioning Systems, Inc., Livermore, CA (US)

(72) Inventors: Anton Pavlovich Stepanenko, Moscow (RU); Dmitry Vitalievich Tatarnikov, Moscow (RU); Andrey Vitalievich Astakhov, Moscow (RU)

(73) Assignee: Topcon Positioning Systems, Inc., Livermore, CA (US)

( * ) Notice: Subject to any disclaimer, the term of this patent is extended or adjusted under 35 U.S.C. 154(b) by 490 days.

(21) Appl. No.: 16/344,476

(22) PCT Filed: Nov. 13, 2018

(86) PCT No.: PCT/RU2018/000743
§ 371 (c)(1),
(2) Date: Apr. 24, 2019

(87) PCT Pub. No.: WO2020/101519
PCT Pub. Date: May 22, 2020

(51) Int. Cl.

| | |
|---|---|
| ***H01Q 11/08*** | (2006.01) |
| ***H01Q 1/24*** | (2006.01) |
| ***H01Q 5/314*** | (2015.01) |
| ***H01Q 21/28*** | (2006.01) |

(52) U.S. Cl.
CPC ..... *H01Q 11/08* (2013.01); *H01Q 1/241* (2013.01); *H01Q 5/314* (2015.01); *H01Q 21/28* (2013.01)

(58) Field of Classification Search
CPC ..... H01Q 1/241; H01Q 1/36; H01Q 1/362; H01Q 1/38; H01Q 5/20; H01Q 5/314; H01Q 5/321; H01Q 9/30; H01Q 9/32; H01Q 9/38; H01Q 11/08; H01Q 21/28
See application file for complete search history.

(56) References Cited

U.S. PATENT DOCUMENTS

| | | | | |
|---|---|---|---|---|
| 6,181,286 | B1 * | 1/2001 | Roscoe | H01Q 1/362 343/725 |
| 6,344,834 | B1 | 2/2002 | Josypenko | |
| 6,407,720 | B1 | 6/2002 | Josypenko | |

(Continued)

FOREIGN PATENT DOCUMENTS

| | | | |
|---|---|---|---|
| EP | 1833116 | A2 | 9/2007 |
| WO | 2016/163909 | A1 | 10/2016 |

OTHER PUBLICATIONS

Search report in PCT/RU2018/000743, dated Aug. 15, 2019.

*Primary Examiner* — Robert Karacsony
(74) *Attorney, Agent, or Firm* — Bardmesser Law Group

(57) ABSTRACT

A GNSS-UHF antenna, including a first PCB having four sets of radiating elements, a second PCB below the first PCB, a metal plate below the second PCB, which form a quadrifilar helical antenna for operating with right-hand circularly polarized GNSS signals and simultaneously form a monopole antenna for operating with linearly polarized UHF signals; for each set of radiating elements, a corresponding downward-extending conductor connected to the second PCB at a first end and connected to the set of radiating elements at a second end through an inductor; a first coaxial cable outputting GNSS signals; the first cable includes a partial loop between the second shield and the metal plate; and a second cable outputting the UHF and its braiding connected to the metal plate.

20 Claims, 13 Drawing Sheets

(56) References Cited

U.S. PATENT DOCUMENTS 6,429,830 B2 8/2002 Noro et al.
6,621,458 B1 * 9/2003 Petros ..... H01Q 1/38
343/700 MS

* cited by examiner

COMPACT INTEGRATED GNSS-UHF ANTENNA SYSTEM

BACKGROUND OF THE INVENTION

Field of the Invention

A compact integrated antenna system for high-precision satellite positioning is proposed. It enables to receive satellite signals of the GNSS band as well as differential corrections in the UHF band. The antenna system includes a quadrifilar helical antenna, an LNA, and an additional excitation system allowing helical antenna's conductors to be used for GNSS signal reception as well as for receiving and transmitting UHF signals.

Background of the Related Art

Real-time high-precision positioning requires antenna systems with quality reception of both GNSS signals and differential corrections. The frequency band of GNSS signals is 1165-1300 MHz and 1530-1605 MHz. Differential corrections are often transmitted in the UHF band (400-500 MHz). Such systems are normally portable, so reducing their size is a critical factor.

Such an antenna system normally includes a receiving GNSS antenna arranged on the ground plane, and a receiving-transmitting monopole antenna of the UHF band located over or under GNSS antenna. The GNSS antenna typically includes a ground plane to suppress signals reflected from the underlying ground surface. A lateral dimension of the antenna system is normally defined by the size of the ground plane. Height dimension is typically determined by the height of the UHF antenna. The height of the UHF monopole antenna is $\lambda/4$, where $\lambda$ is the wavelength of the UHF band, i.e., the height is about 150-200 mm.

US patent publication no. 2013/0241783 discloses an integrated antenna system, with a GNSS antenna being a stacked shorted annular ring patch antenna and a UHF antenna in the form of a sleeve monopole. To reduce the size of the UHF antenna, a ferrite coating is proposed, which substantially complicates the antenna manufacturing process. In addition, to efficiently suppress signals reflected from the underlying ground surface, this patch antenna needs a ground plane having lateral dimension of approximately 120-150 mm.

US patent publication no. 2012/0075153 discloses a multiband antenna monopole structure with a helical load extending from the monopole. Due to that, antenna height in the UHF band is reduced, and reception of GNSS signals is provided. However, UHF and GNSS signals in such a structure are fed to the same input, and an additional component is required to divide them (UHF/GPS Diplexer); the latter results in complicating the structure and additional loss of the received signal strength. The directional patterns presented in this application show that such a structure does not practically suppress signals reflected from underlying ground surface, making the antenna system useless for high-precision positioning.

Efficient suppression of signals reflected from the underlying ground surface at small lateral dimensions can be provided by quadrifilar helical antennas, see, for example, U.S. Pat. No. 9,837,709 (B2). A smaller lateral size is ensured by lack of a large ground plane. The ground plane in such a structure can be made such as not to protrude beyond the limits of the spiral elements and serves as a base for arranging the excitation circuit.

Thus, an integrated GNSS-UHF antenna system based on a quadrifilar helix antenna and having small vertical dimension and separate GNSS and UHF outputs is desirable.

SUMMARY OF THE INVENTION

The present invention proposes an integrated antenna system comprising a quadrifilar helical antenna operating in the GNSS band (GNSS antenna) and a UHF antenna operating in the band of 400-500 MHz. Each antenna has a separate output cable. The antenna is adjusted such that it receives right circularly polarized electromagnetic waves in the GNSS band, and linear polarized waves in the UHF band. A characteristic feature of this structure is the use of spiral elements of the GNSS antenna as radiating elements of the UHF antenna. It makes possible to implement a compact antenna system with efficient suppression of signals reflected from the underlying ground surface. Excitation of spiral elements in both GNSS and UHF bands is carried out by separate cables, which makes it unnecessary to add any devices for splitting signals, such as a UHF/GPS Diplexer.

Additional features and advantages of the invention will be set forth in the description that follows, and in part will be apparent from the description, or may be learned by practice of the invention. The advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE ATTACHED FIGURES

The accompanying drawings, which are included to provide a further understanding of the invention and are incorporated in and constitute a part of this specification, illustrate embodiments of the invention and together with the description serve to explain the principles of the invention.

Figure 7B:
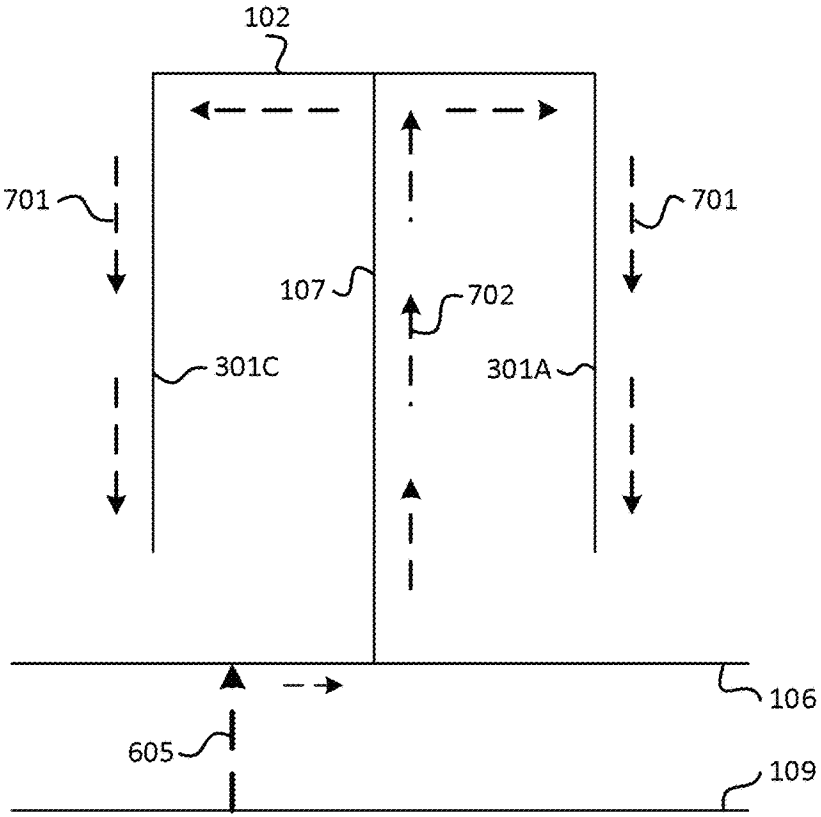
Figure 7A:
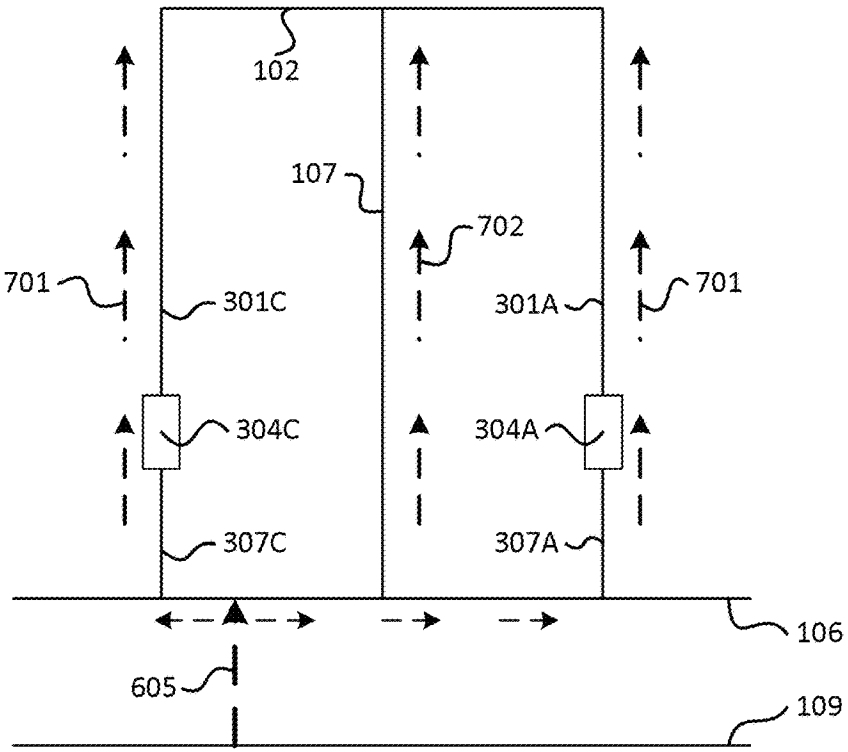
Figure 8A:
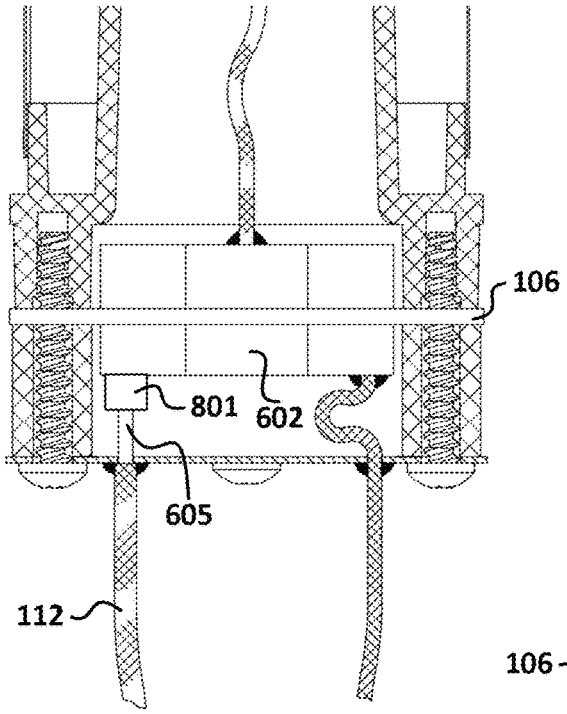
Figure 8B:
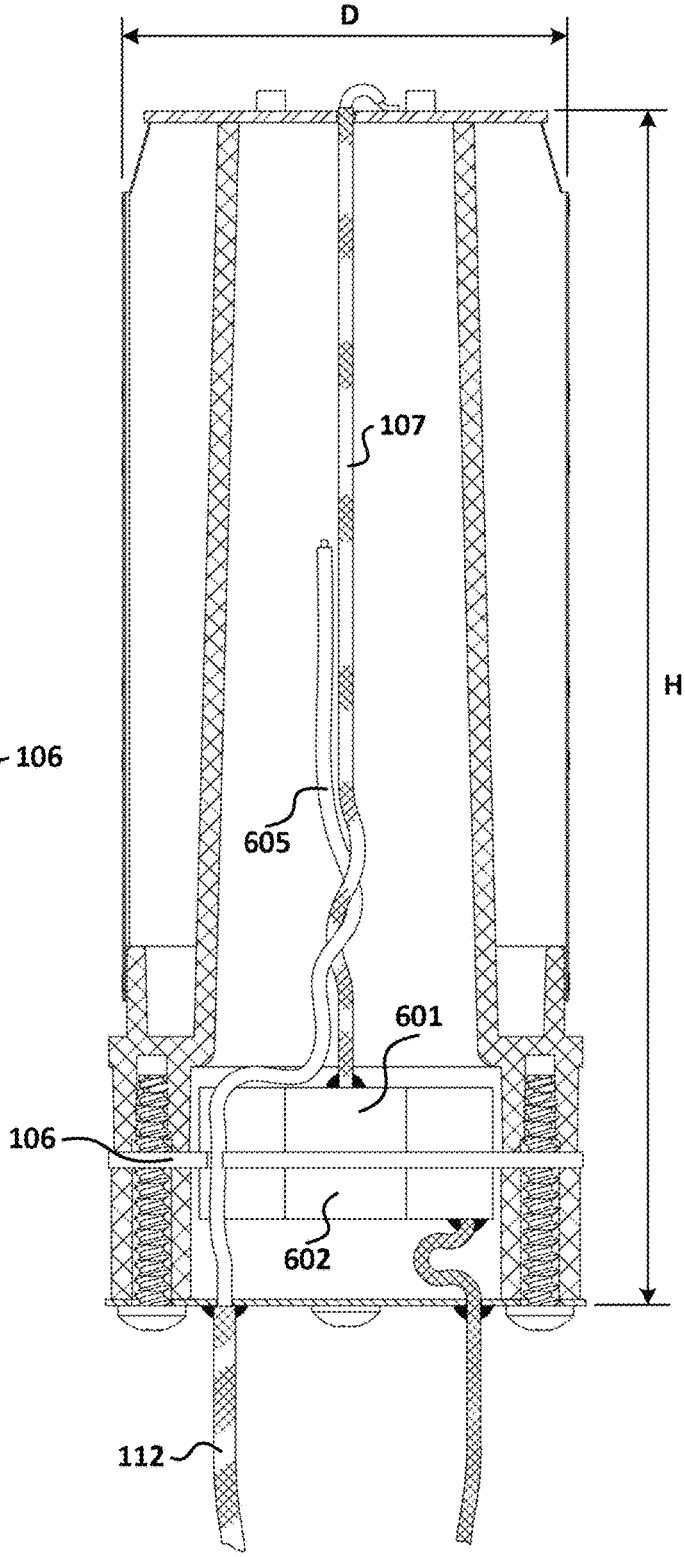
Figure 9:
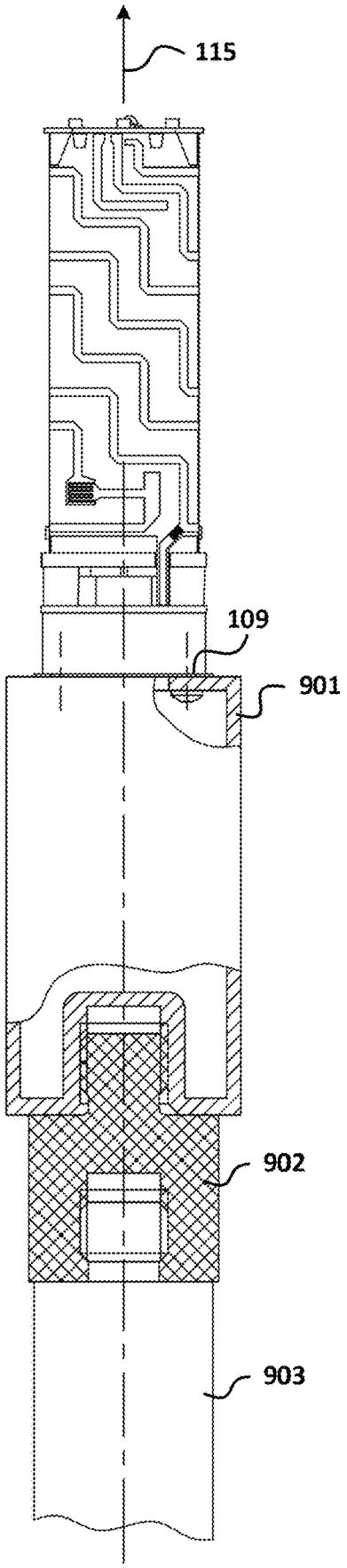

FIG. 7A, FIG. 7B schematically show currents flowing in the UHF band;

FIG. 8A, FIG. 8B show a variant of excitation system in the UHF band;

FIG. 9 shows proposed antenna system installed on a receiver housing; and

FIG. 10 shows measured VSWR plots.

DETAILED DESCRIPTION OF EMBODIMENTS OF THE INVENTION

Reference will now be made in detail to the embodiments of the present invention, examples of which are illustrated in the accompanying drawings.

Figure 1:
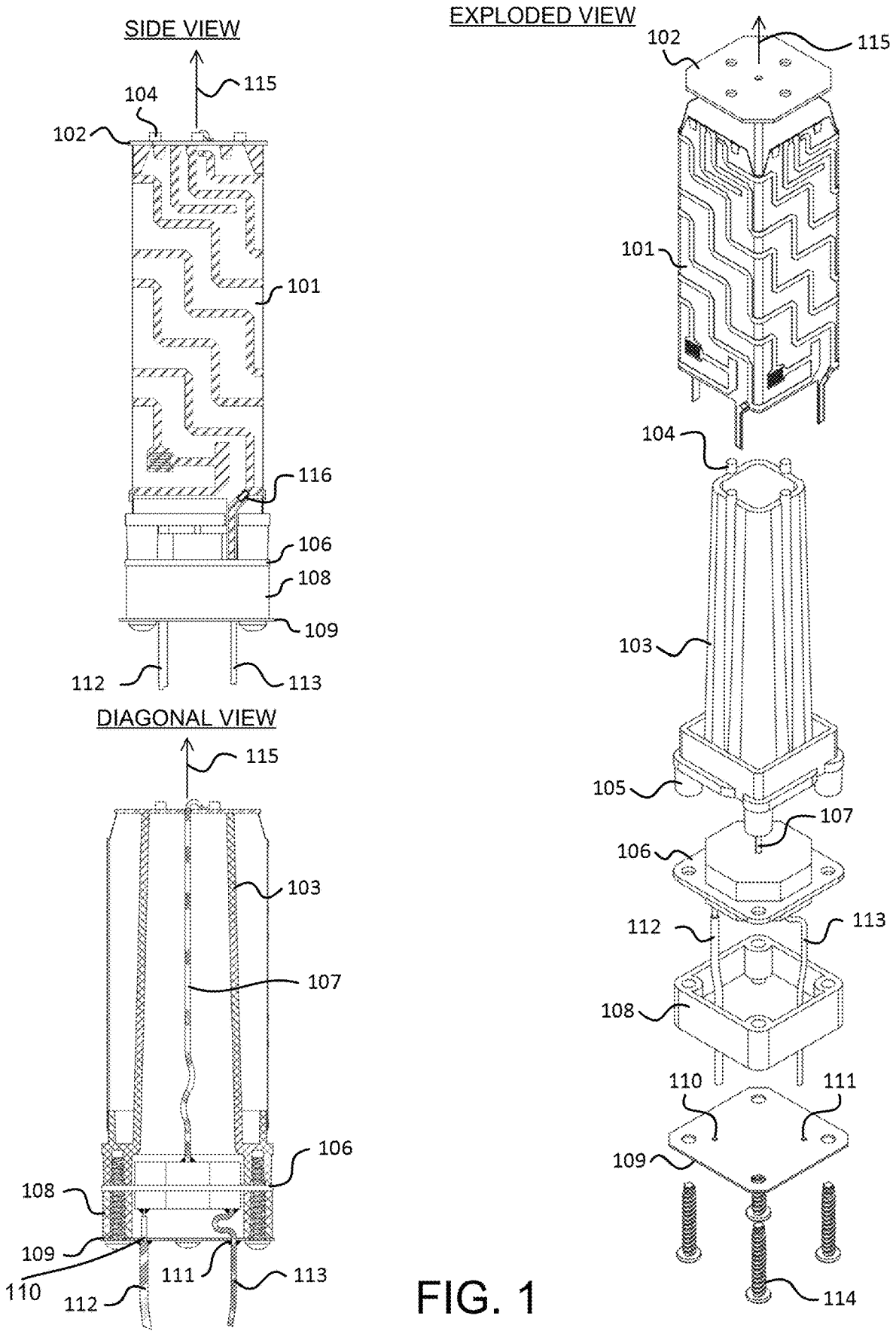
FIG. 1 shows the embodiment of the proposed antenna system.

A design of a proposed integrated GNSS/UHF antenna system is shown in FIG. 1. It includes a flexible printed circuit board (PCB) 101 with four similar sets of radiating elements. The board is bent such that radiating elements of board 101 would be symmetrical relative to the vertical axis 115, namely they have 4-fold rotational symmetry (90°) relative to the vertical axis 115. PCB 101 has a bottom and top parts. Vertical axis 115 is directed from the bottom to the top. At the top of PCB 101 there is PCB 102. At the bottom of PCB 101 there is PCB 106. Boards 102 and 106 are oriented perpendicularly to vertical axis 115. On PCB 102 there is an excitation circuit of radiating elements located on PCB 101 operating in the GNSS band. On PCB 106 there is a low noise amplifier (LNA) also operating in the GNSS band. Upper ends of the radiating elements of board 101 are soldered to conductors of the excitation circuit located on PCB 102. The structure is supported by a plastic base 103. At the top of base 103 there are four bosses 104 which are inserted in the corresponding holes in PCB 102. At the bottom of base 103 there are four bosses 105 to which PCB 106 is attached. Some of bottom ends of the radiating elements of board 101 may be connected to PCB 106 via inductors 116. Between boards 102 and 106 along the symmetry axis 115 there is a coaxial cable 107, one end of which is connected to the input of the excitation circuit on board 102, the other one—to the input of LNA. Beneath PCB 106, at a certain distance from it, there is a metal plate 109. A dielectric support 108 can be placed between PCB 106 and metal plate 109 for the purpose of mechanical fixing. In metal plate 109 there are holes 110 and 111. Cable 112 of the UHF antenna passes through hole 110, and cable 113 of the GNSS antenna passes through hole 111. External braiding of cable 112 has galvanic contact with metal plate 109 near hole 110, external braiding of cable 113 has galvanic contact with metal plate 109 near hole 111. Cable 113 is connected to the LNA output and is the output of the GNSS antenna. Coaxial cable 112 and metal plate 109 form an additional excitation system of radiating elements located on board 101, in the UHF band. Cable 112 is the output of the UHF antenna.

Metal plate 109, base 108, PCB 106 can be fastened to base 103, for example, using screws 114. Note that there is no electric contact between screws 114 and wires on board 106.

Plastic bases 103 and 108 fasten boards 101, 102, 106 to metal plate 109. FIG. 1 shows an example of their design. Boards 101, 102, 106 can also be mechanically fastened to shield 109 in a manner different from that shown in FIG. 1.

Figure 2A:
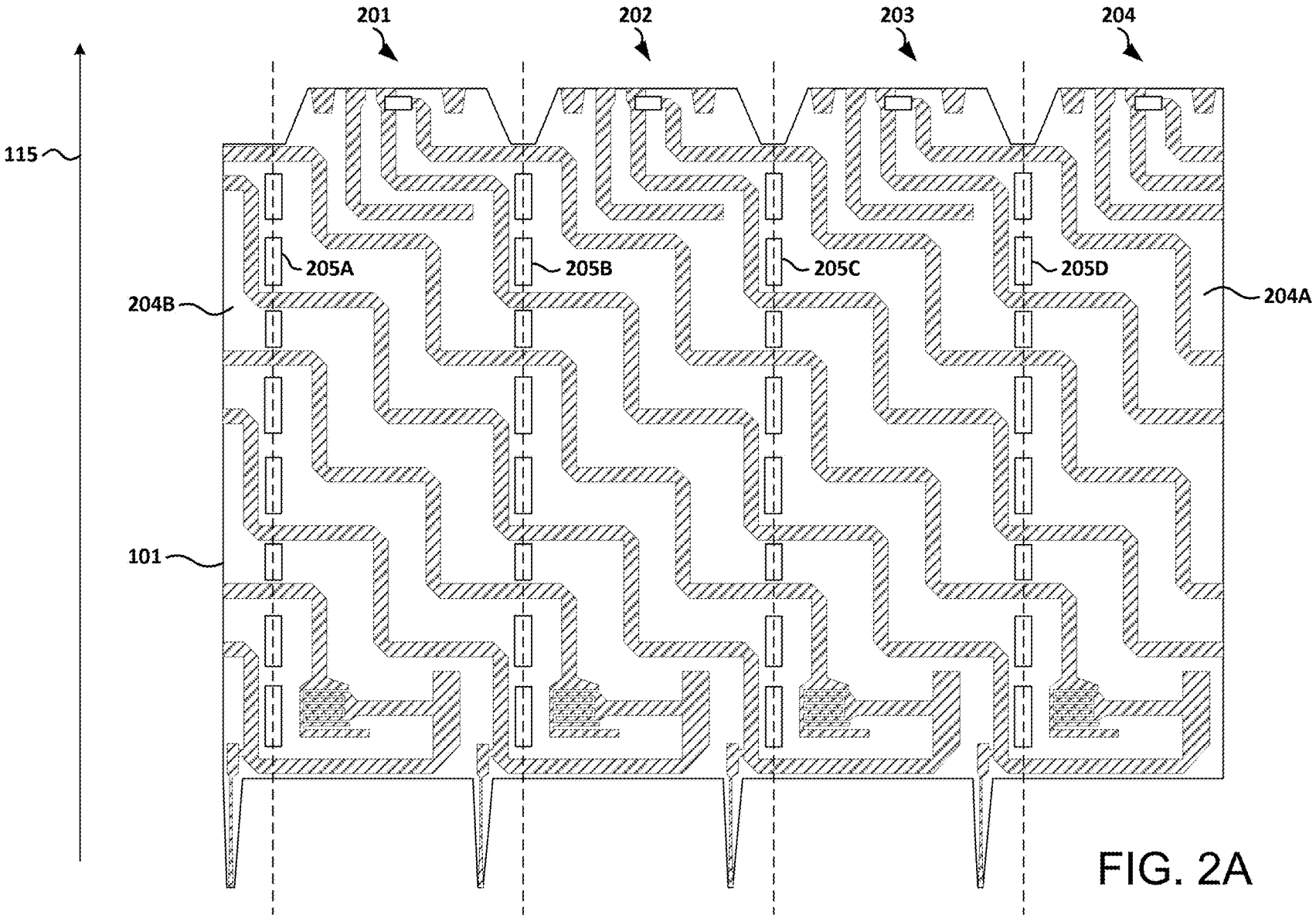
FIG. 2A-FIG. 2C show a PCB of the helical antenna.
Figure 2B:
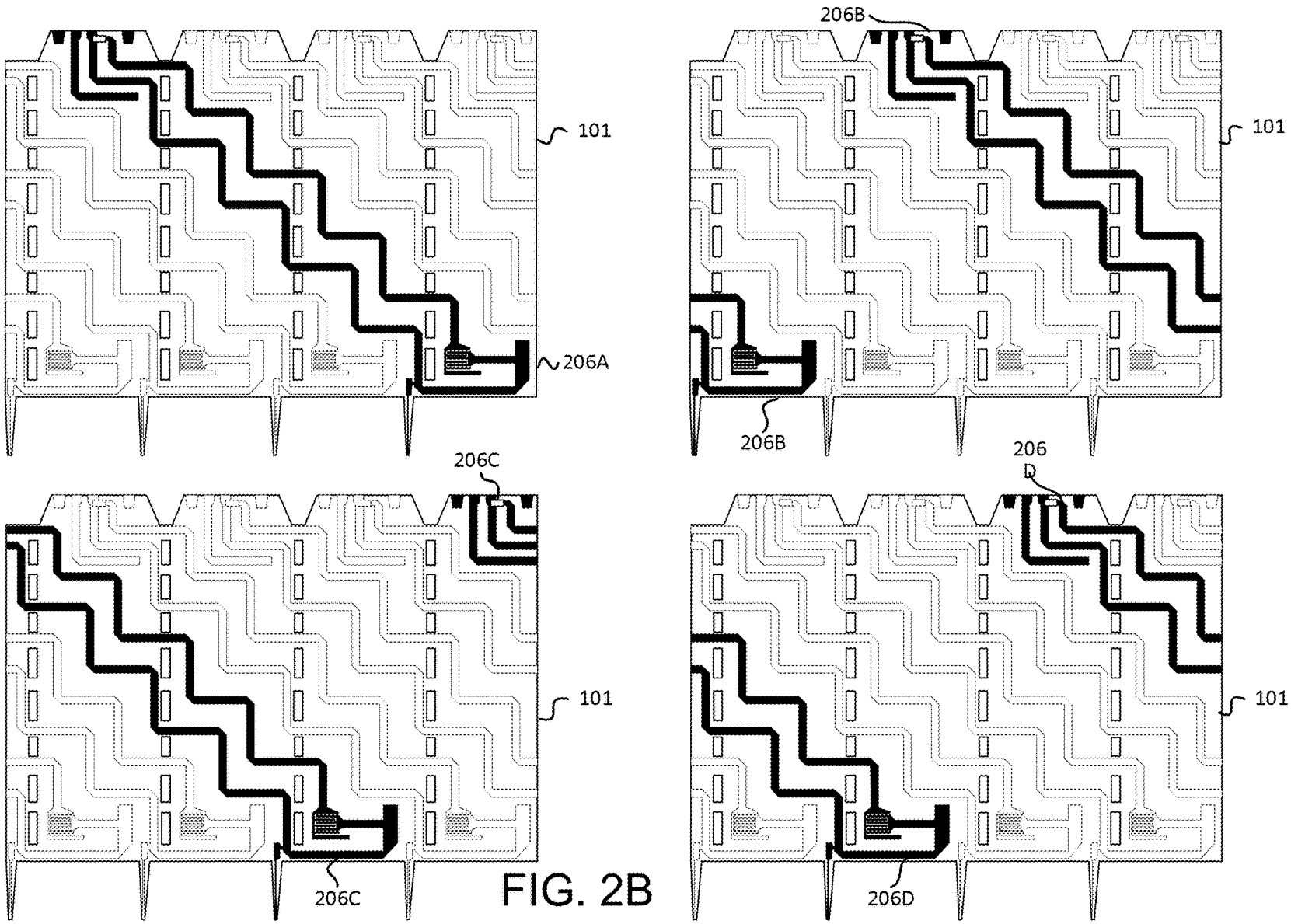
Figure 2C:
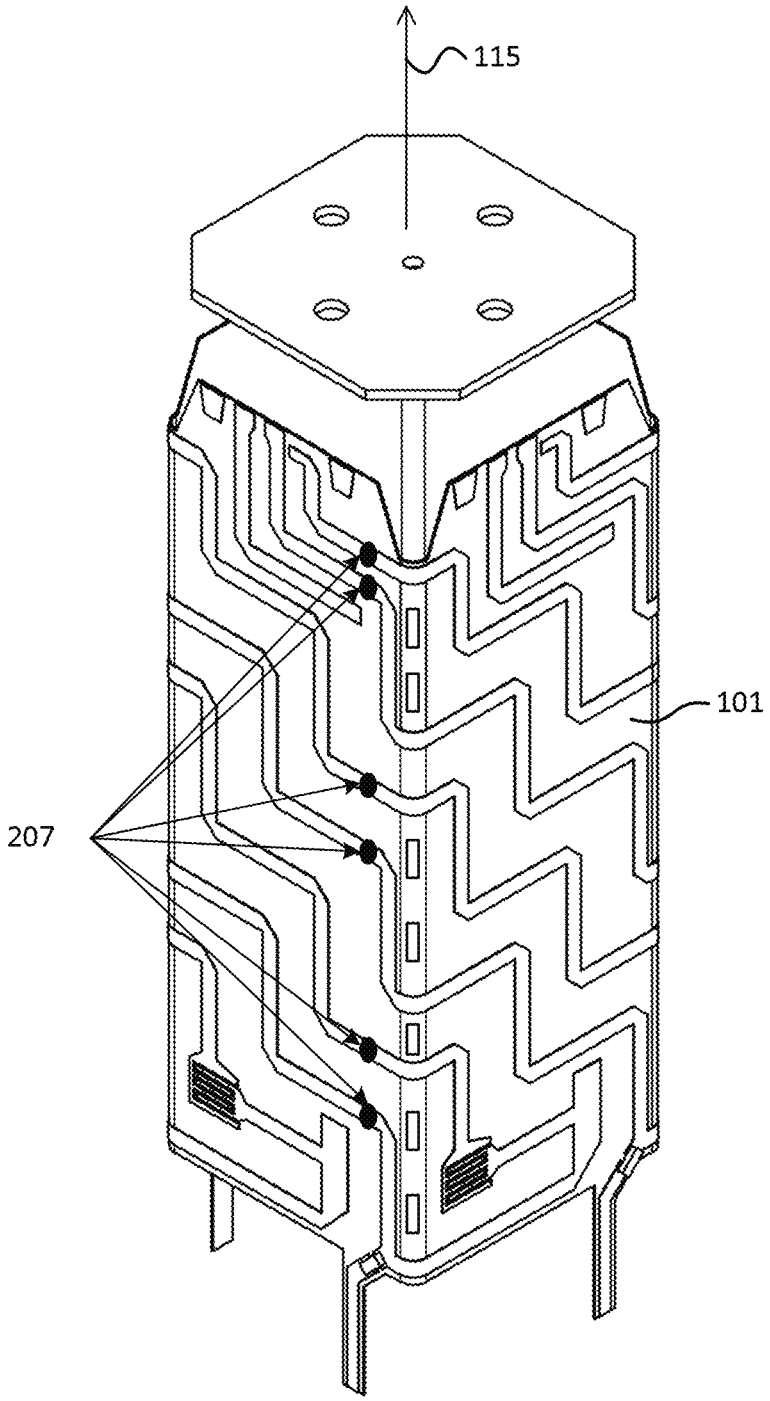

FIG. 2A shows the PCB 101 in an unrolled state. PCB 101 has four sectors 201, 202, 203,204. Between sectors there are four sets of rectangular holes 205A, 205B, 205C, 205D. Each hole set 205 is arranged parallel to vertical axis 115. Sector 204 consists of two parts 204A and 204B. The PCB 101 in the unrolled state shows part 204A at the right end of board 101, and part 204B at the left end of board 101. Onto board 101 there are four similar sets of radiating elements 206A, 206B, 206C, 206D. These sets are shown in FIG. 2B. Here, each corresponding set is marked in black. Each set 206B, 206C and 206D has two parts, one part at the left end of board 101, the other one is at the right side of board 101. Board 101 is bent along hole sets 205 as shown in FIG. 2C. The sets of radiating elements 206A, 206B, 206C and 206D are symmetrical relative to vertical axis 115. Corresponding parts of conductors in sets 206B, 206C and 206D are galvanic coupled by soldering at points 207.

Figure 3:
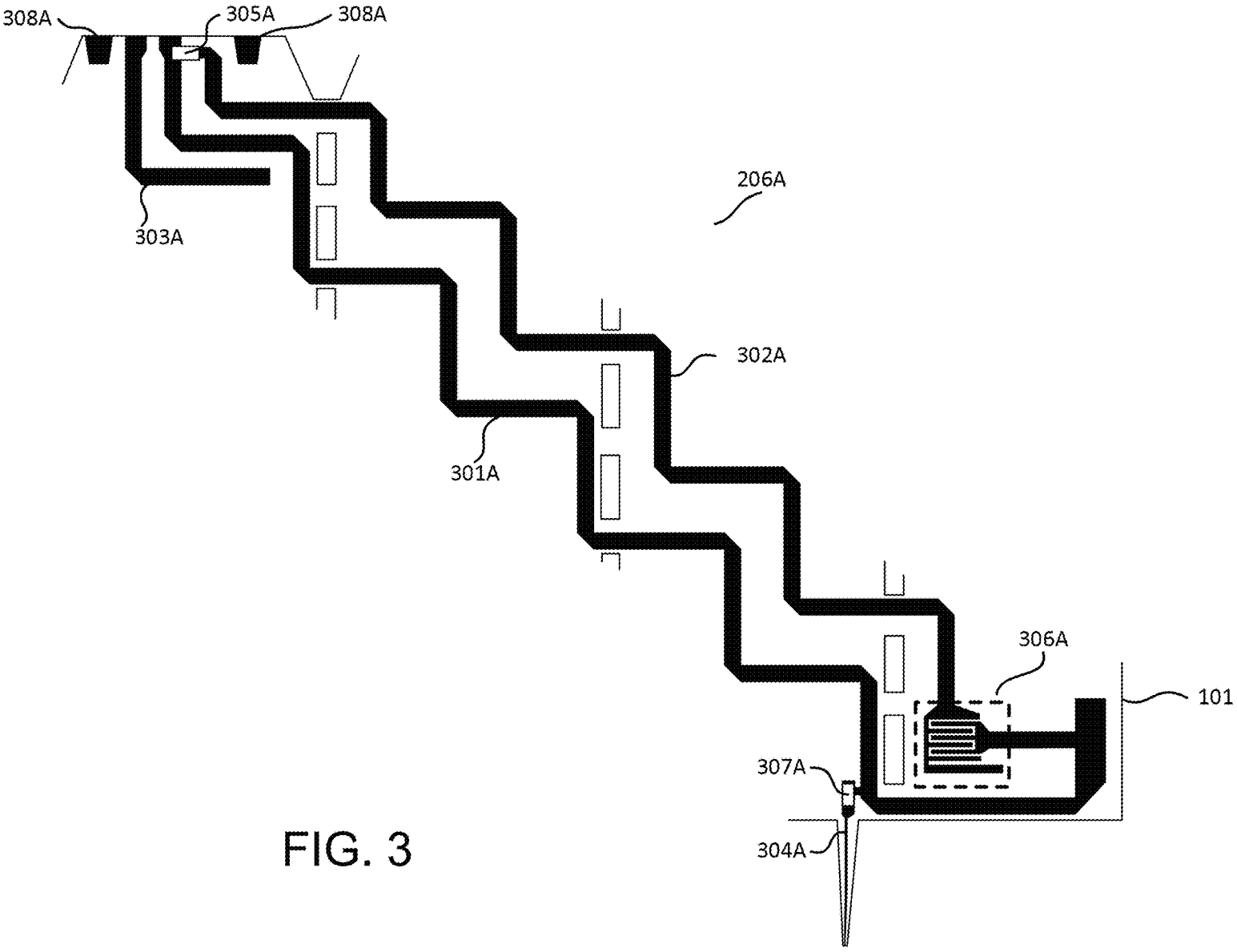
FIG. 3 shows a set of radiating elements.

Each set of radiating elements 206A, 206B, 206C and 206D includes three conductors and two capacitors. FIG. 3 gives an example of set 206A. First conductor 301A is shaped as a zigzag line with length $l_1$. Second conductor 302A is a zigzag line with length $l_2$. At the top of PCB 101 conductors 301A and 302A are coupled via capacitor 305A. At the bottom part of PCB 101 conductors 301A and 302A are coupled through capacitor 306A. The end of conductor 301A is on the top edge of PCB 101 and further is galvanically coupled with PCB 102. Capacitors 305A and 306A can be lumped and/or distributed. In FIG. 3 capacitor 305A is lumped, and capacitor 306A is made as a comb structure. Third conductor 303A is shaped as a zigzag line of length $l_3$ and is at the top of board 101. Its upper end is at the upper edge of board 101 and galvanic coupled with PCB 102. In addition to conductors 301A, 302A, 303A and capacitors 305A, 306A, there are inductor 307A and conductor 304A. Conductor 304A of length $l_4$ is located at the bottom of board 101. Its upper end is connected to inductor 307A which in turn is connected to conductor 301A. The bottom end of conductor 304A is on the lower edge of PCB 101, which has a special tooth-shaped protrusion. The lower end of conductor 304A is galvanically coupled with PCB 106, the galvanic coupling being ensured by soldering.

There are also metallized spots 308A serving for additional mechanic fastening of boards 101 and 102. The attachment is made by soldering.

The design of sets 206B, 206C and 206D are similar to the description of set 206A.

Figure 4A:
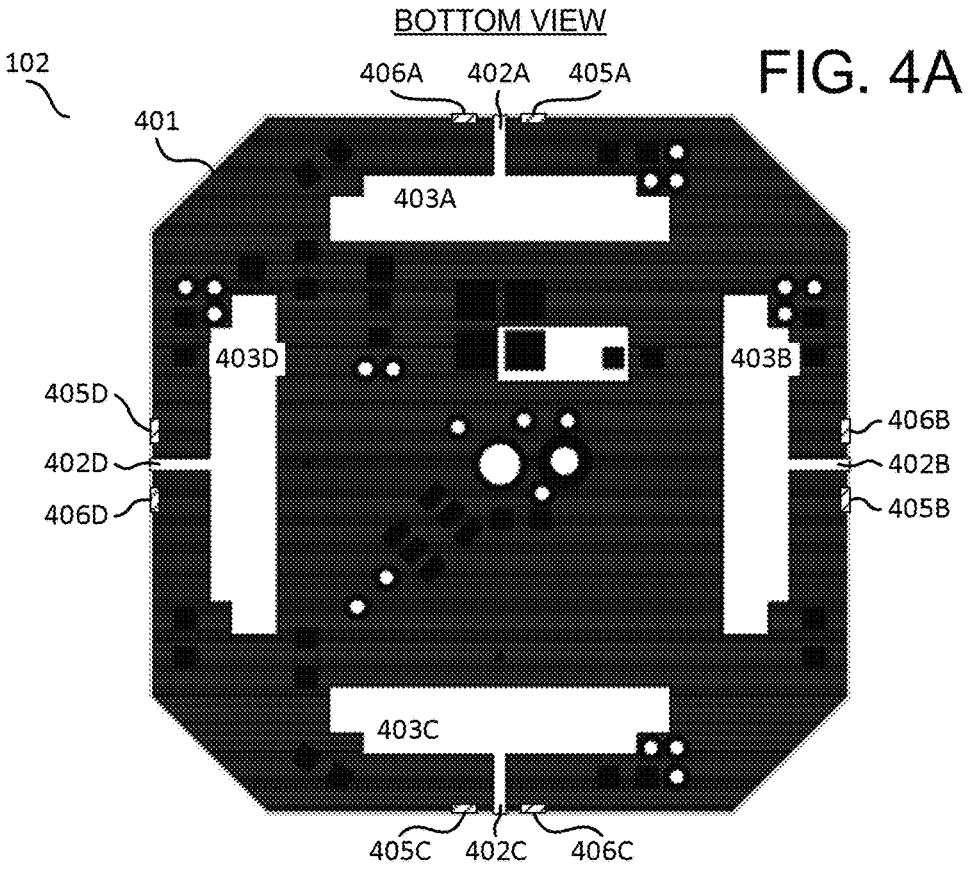
FIG. 4A, FIG. 4B show the excitation circuit's PCB.
Figure 4B:
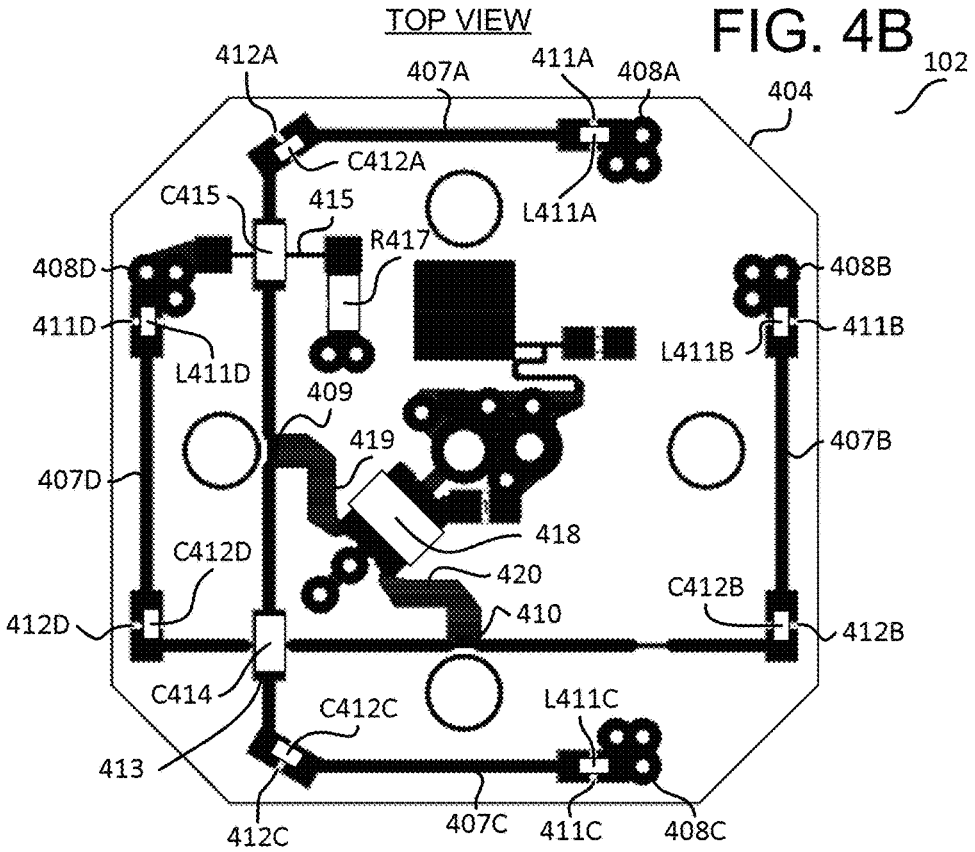

FIG. 4 shows PCB 102. Board 102 has lower and upper layers of metallization depicted in FIG. 4A and FIG. 4B respectively.

Figure 5:
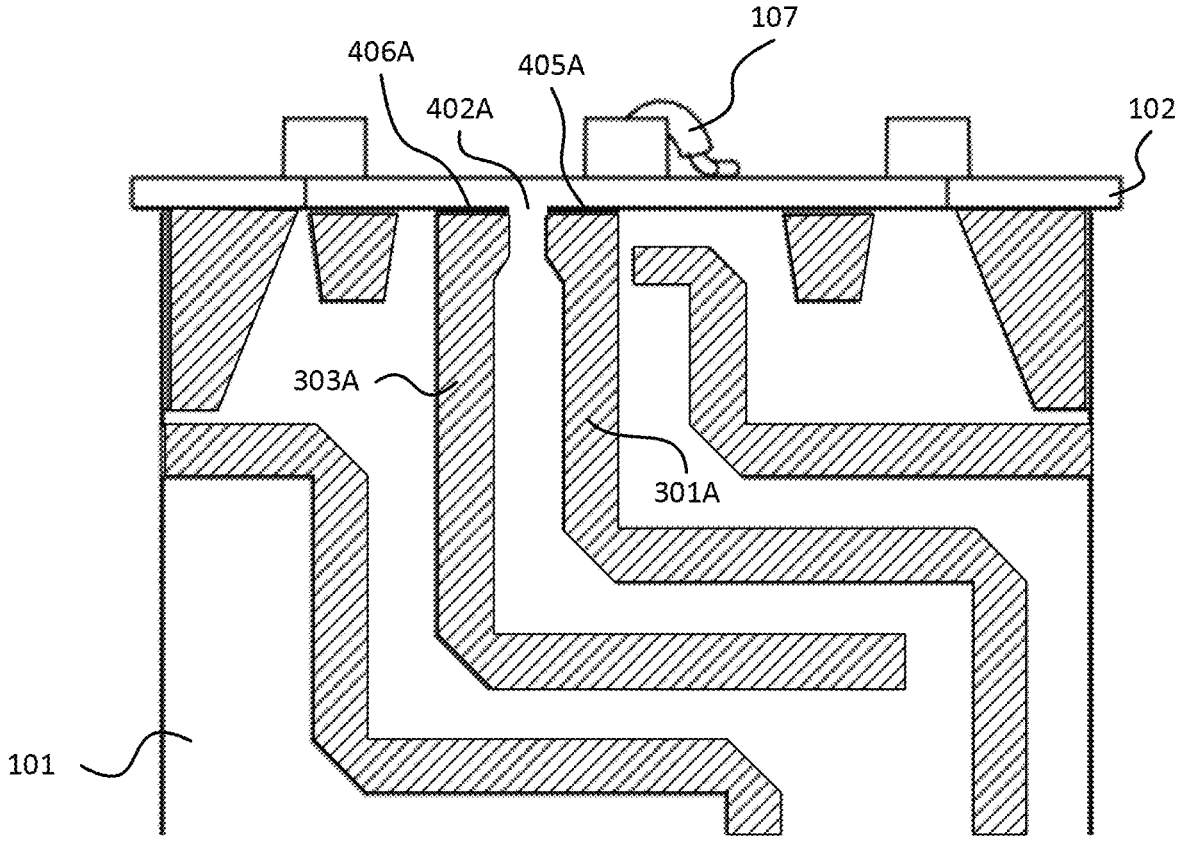
FIG. 5 shows a side view of the area of connection the excitation circuit PCB and the flexible PCB of radiating elements.

In the lower metallization layer 401 there are four slots 402A, 402B, 402C and 402D, as well as four slots 403A, 403B, 403C and 403D. These slots are located close to edge 404 of board 102. Slots 402A, 402B, 402C and 402D are perpendicular to the boundary 404, slots 403A, 403B, 403C and 403D are oriented parallel to boundary 404. Slot 402A is abutted on slot 403A. Similarly, slots 402B, 402C and 402D are abutted on the corresponding slots 403B, 403C and 403D. Near slot 402A there are solder points 405A and 406A of conductors 301A and 303A, respectively, placed on board 101. These points are also indicated in FIG. 5. Conductor 301A is soldered to conductor 401 from one side of slot 402A at point 405A, conductor 303A is soldered to conductor 401 from the other side of slot 402A at point 406A. Similarly, conductors 301B, 301C, 301D and 303B, 303C, 303D are soldered to conductor 401 at the corresponding points of soldering 405B, 405C, 405D and 406B, 406C, 406D.

In the upper metallization layer of board 102 there are conductors 407A, 407B, 407C and 407D. These conductors form microstrip lines, the ground plane of which is conductor 401. The width of conductors 407A, 407B, 407C and 407D is selected such that wave resistance of microstrip lines formed by them would be 100 Ohm. Conductor 407A starts at point 408A and ends at point 409. Conductor 407B starts at point 408B and ends at point 410. Conductor 407C starts at point 408C and ends at point 409. Conductor 407D starts at point 408D and ends at point 410. At points 408A, 408B, 408C and 408D there are metallized holes connecting conductors 407A, 407B, 407C and 407D with conductor 401. Conductor 407A has breaks at points 411A and 412A. Lumped inductor L411A is connected to break 411A, and lumped capacitor C412A is connected to break 412A. In the same manner, conductors 407B, 407C and 407D have corresponding breaks 411B, 411C, 411D with connected lumped inductors L411B, L411C, L411D and breaks 407B, 407C, 407D with connected lumped capacitors C412B, C412C, C412D. Nominal values of inductors L411A, L411B, L411C, L411D are the same and equal to L411. Nominal values of capacitors C412A, C412B, C412C, C412D are the same and equal to C412.

Conductors 407C and 407D cross over at point 413. To avoid galvanic contact between these conductors in the vicinity of this point, conductor 407D has a narrowing and conductor 407C has a break. Capacitor C413 is connected in the break, its capacitance is approximately 100 pF. At GNSS frequencies such a capacitor has a resistance close to that of short circuit. To provide phase incursion of the microstrip line formed by conductor 407A equal to that of the microstrip line formed by conductor 407C, line 407A also has a break with connected capacitor C415, its capacitance is approximately 100 pF. To achieve a better identity of operating modes in microstrip lines formed by conductors 407A and 407C, there is a piece of conductor 416 under capacitor C415 which imitates a narrowing of conductor 407D at point 413. One end of the piece of conductor 415 is connected to the metallized hole located at point 408D, and its other end is connected to resistor R417 having resistance 50 Ohm. The other end of resistor R417 is connected to conductor 401 via a metallized hole.

On the top layer of metallization of power splitter board 102 there is a 3 dB 90° power coupler 418. It has an input and two outputs. The first output is connected to point 409 via line 419. The second output is connected to point 410 via line 420. Lines 419 and 420 have a wave impedance 50 Ohm. Coaxial cable 107 passes through hole 421. Cable 107 is shown in FIG. 5. Its braiding is soldered to conductor 401, the center conductor is connected to the input of 3 dB 90° power coupler 418. Thus, electromagnetic wave fed to cable 107 via the 3 dB 90° power coupler 418 comes to microstrip lines formed by conductors 407A, 407B, 407C, 407D. Each of these conductors crosses the corresponding slots 402A, 402B, 402C and 402D. Currents flowing over these conductors excite electromagnetic fields with equal amplitudes in slots 402A, 402B, 402C and 402D, the fields in slots 402A and 402C being in-phase. In slots 402B and 402D the field are also in-phase. This can be achieved by the fact that the lengths of conductor cuts 407A, 407B, 407C, 407D and nominal values of connected capacitors and inductors are selected equal. Field in slots 402A and 402B has a phase difference of 90°. Respectively, field in slots 402C and 402D also has phase difference of 90°. This difference is provided by the 3 dB 90° power coupler 418. Therefore, PCB 102 ensures equally-amplitude power division supplied by cable 107. This means that the electromagnetic field in the opposite slots is in-phase and has phase difference 900 in neighboring slots.

Electromagnetic field excited in slots 402A, 402B, 402C and 402D causes currents with the same amplitudes and a phase shift 90° between neighboring elements in sets of radiating elements 206A, 206B, 206C and 206D. Electromagnetic field generated by these currents excites a right hand circularly polarized (RHCP) electromagnetic wave propagating in the direction of vertical axis 115. Therefore, PCB 101 and 102 form a quadrifilar helical antenna operating in the GNSS band. A directional diagram (DD) of such an antenna has maximum in the direction of the vertical axis 115. When signals are received from satellites, this direction corresponds to the zenith direction. The value of DD in the direction opposite to vertical axis 115 (the nadir direction) is low enough, such that it makes possible to reduce positioning errors caused by signals reflected from the underlying ground surface. The ratio of DD value in the nadir direction to that of the zenith direction is about −14 dB.

Figure 6B:
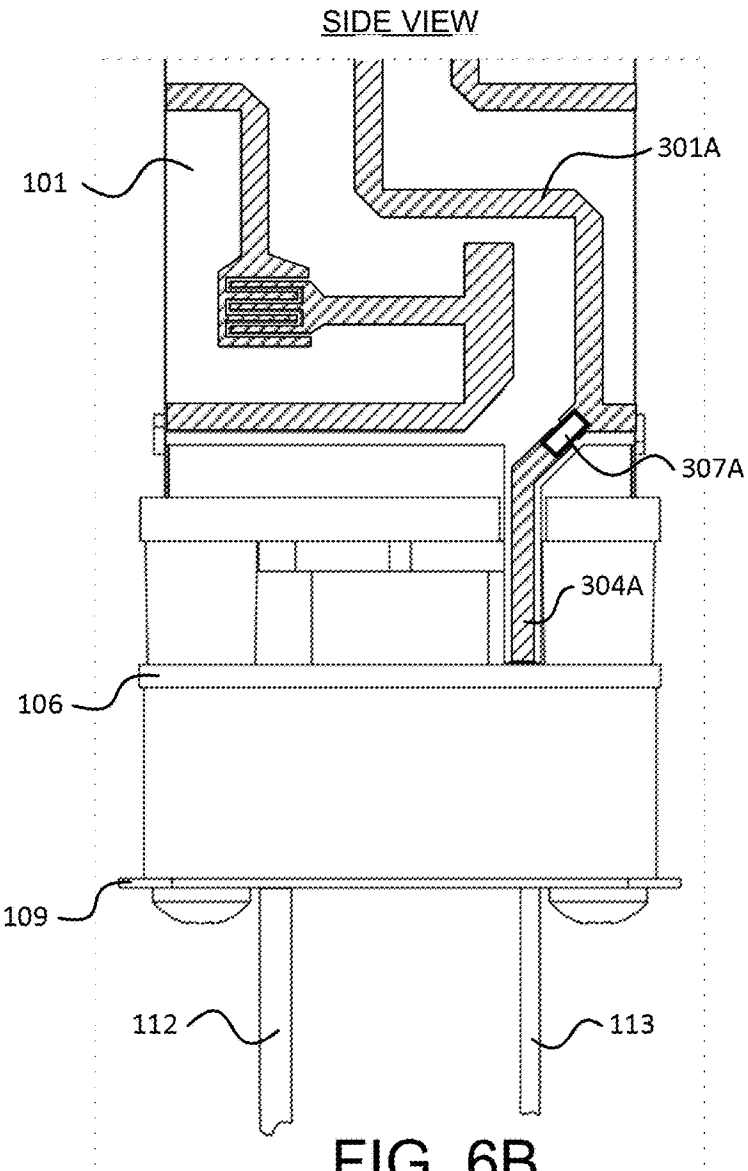
FIG. 6A, FIG. 6B show the structure of the excitation system in the UHF band.
Figure 6A:
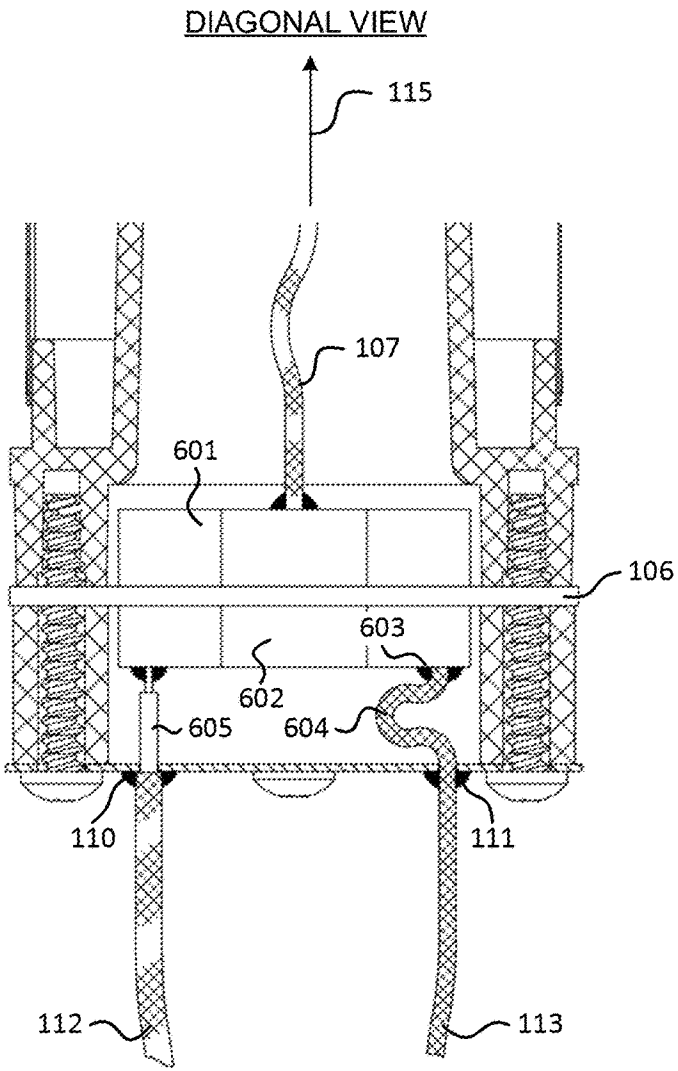

Cable 107 from power splitter board 102 comes along vertical axis 115 to board 106. On board 106 there is a low-noise amplifier (LNA). To provide electromagnetic compatibility, LNA components are covered by two metal shields 601 and 602 (FIG. 6). Shield 601 is located at the top side of board 106, shield 602 is located at the bottom side of board 106. Shields 601 and 602 are coupled to the common (ground) LNA conductor. The braiding of cable 107 is soldered to shield 601, the center conductor of cable 107 is connected to the LNA input. The center conductor of cable 113 is connected to the LNA output. The braiding of cable 113 is soldered to shield 602. Cable 113 passes further through the hole in the metal plate 109. The braiding of cable 113 is soldered to metal plate 109. Cable 113 is the output cable of the GNSS antenna.

The metal plate 109 has an opening 110. The center conductor of cable 112 passes through this opening. The braiding of cable 112 is soldered to metal plate 109. Center conductor 605 of cable 112 has no galvanic contact with metal plate 109, it passes through opening 110 in isolation. Center conductor 605 of cable 112 is soldered out to shield 602. One end of conductor 304A located on board 101 and is connected to the common LNA conductor on board 106. As noted above, the other end of conductor 304A is connected to inductance 307A which in turn is connected to conductor 301A. Conductors 304B, 304C and 304D are connected similarly. Inductors 307A, 307B, 307C, 307D have the same nominal value L307. This value is selected such that its reactive impedance would be low enough in the UHF frequency band and high enough in the GNSS frequency band. Thus, at UHF frequency conductors 301A, 301B, 301C, 301D are shorted to the common LNA conductor through reactive impedance of inductors 307A, 307B, 307C, 307D, while at GNSS frequencies conductors 301A, 301B, 301C, 301D become separated from the common LNA conductor. Since the common LNA conductor is coupled with shield 602, and the shield in turn is connected to center conductor 605 of cable 112, at UHF band frequency center, the conductor 605 of cable 112 becomes connected to conductors 301A, 301B, 301C, 301D. In the same way as the braiding of cable 107 is connected to shield 601, shield 601 is connected to the common LNA conductor, the common LNA conductor is connected to shield 602, and shield 602 is connected to the center conductor of cable 112, center conductor 605 of cable 112 turns out to be connected to the braiding of cable 107. Therefore, the braiding of cable 107, conductors 301A, 301B, 301C, 301D, shields 601, 602 and screen 109 are a monopole UHF antenna excited by electromagnet waves fed via cable 112. Conductors 301A, 301B, 301C, 301D are part of conductors of GNSS spiral antenna. Lengths of conductors 301A, 301B, 301C, 301D are selected to provide a matched mode in both UHF and GNSS bands.

FIG. 7 schematically shows directions of currents flowing in UHF band when inductors 307A, 307B, 307C, 307D are available/unavailable. When the inductors are available (FIG. 7A), current from the center conductor of cable 112 flows to the common conductor of board 106, whence it flows in conductors 307A, 307B, 307C, 307D and in the braiding of cable 107. From conductors 304A,304B, 304C, 304D the current flows in conductors 301A, 301B, 301C, 301D via inductors 307A, 307B, 307C, 307D. Thus, conductors 301A, 301B, 301C, 301D and the braiding of cable 701 are connected in parallel.

It can be seen that current 701 in conductors 301A, 301B, 301C, 301D and current 702 in the braiding of cable 107 appeared to be in-phase. So the fields generated by them are added. It enables to match the UHF antenna in the required bandwidth. When inductors 307A, 307B, 307C, 307D (FIG. 7B) are unavailable, the braiding of cable 107 is series-connected to conductors 301A, 301B, 301C, 301D. It can be seen that current 701 in conductors 301A, 301B, 301C, 301D and current 702 flowing in the braiding of cable 107 appear to be opposite in phase. Hence, electromagnet fields generated by them are subtracted, and it makes impossible to match the antenna in the required bandwidth.

Since the cable braiding of GNSS antenna 113 is soldered to shield 602 at point 603, its location strongly affects the operation of the UHF antenna. To reduce these effects, the braiding of cable 113 is also soldered to metal plate 109 at point 111. However, in practice this results in shorting of UHF monopole to metal plate 109 and hence adjustments in the required bandwidth become impossible. To avoid this, cable 113 in the area between screen 109 and shield 602 is shaped as a loop 604. In this case, an inductor is formed from the braiding of cable 113, the latter results in increasing resistance between points 111 and 603.

In one embodiment, center conductor 605 of cable 112 can be connected to shield 602 via capacitor 801 (FIG. 8A), rather than directly. One output of capacitor 801 is connected to center conductor 605, and the other, to shield 602. This capacitor is needed to control antenna's input resistance by adjusting it. In another embodiment, capacitor 801 can be implemented in a way shown in FIG. 8B. Here, center conductor 605 of cable 112 is not soldered to shield 602, and passes through the hole in PCB 106, further it bends shields 602 and 601, and finally wraps around the braiding of cable 107. Center conductor 605 of cable 112 has no galvanic contact with conductors of PCB 106, shield 601, shield 602 PCB 106 and the braiding of cable 107. To ensure this, center conductor 605 is in isolation. Therefore, the continuation of center conductor 605 of cable 112 is one plate of capacitor 801, and the braiding of cable 107 is the other plate of capacitor 801.

In one embodiment, LNA can be absent in PCB 106, in this case shields 601 and 602 can be also absent, and PCB 106 is a flat conducting plate. Then, center conductor 605 of cable 102 can be directly connected to board 106 or center conductor 605 of cable 102 can be connected to board 106 via capacitor 801. Cable 113 is then a continuation of cable 107.

In another embodiment, metal plate 109 can be connected to metal housing 901 of the receiver for high-precision positioning or can be its part. Housing 901 is elongated in the direction of vertical axis 115. In this case, UHF antenna operates as a dipole. One arm of the dipole is the braiding of cable 107, conductors 301A, 301B, 301C, 301D, shields 601, 602, the other arm of the dipole is housing 901 galvanic connected to screen 109. Due to that, amplification of the UHF antenna increases in the direction perpendicular to vertical axis 115 (horizontal direction) and in addition, adjusting of the UHF antenna in the required bandwidth is improved.

A surveying receiver is normally fixed onto a geodetic pole 903. This pole is made of carbon fiber reinforced plastic having some conductivity. Electric currents flowing in the geodetic pole 903 can cause undesirable loss in the UHF antenna and its mismatch. To avoid this, in the proposed invention, a dielectric standoff 902 is installed between receiver housing 901 and pole 903. The length of dielectric standoff 902 is no smaller than 25 mm.

FIG. 10 presents experimental graphs of the voltage standing wave ratio (VSWR) depending on the frequency of the proposed antenna system. Design parameters of the antenna system are as follows:

Height H=90-100 mm,

Width D=25-35 mm,

Length $l_1$ for conductors 301A, 301B, 301C, 301D=165-190 mm

Length $l_2$ for conductors 302A, 302B, 302C, 302D=120-140 mm

Length $l_3$ for conductors 303A, 303B, 303C, 303D=20-30 mm

Length $l_4$ for conductors 304A, 304B, 304C, 304D=10-15 mm

Inductance L411 of inductors L411A, L411B, L411C, L411D=4-5 nH Capacitance C412 of capacitors C412A, C412B, C412C, C412D=0.5-1 pF Inductance L307 of inductors 307A, 307B, 307C, 307D=approx. 30 nH Length of receiver housing 901=100-130 mm.

Figure 10A:
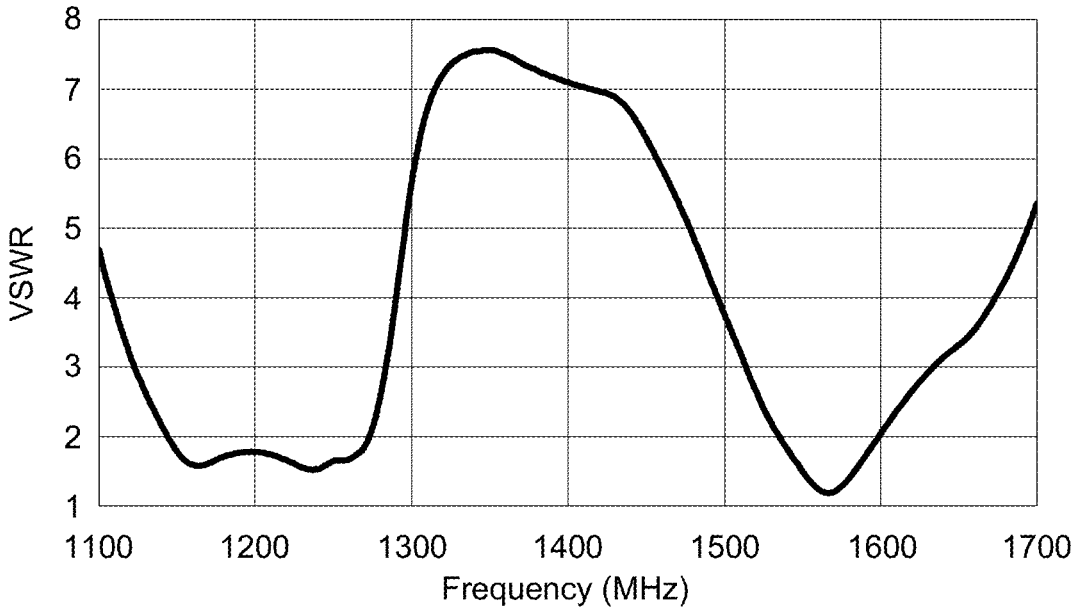
Figure 10B:
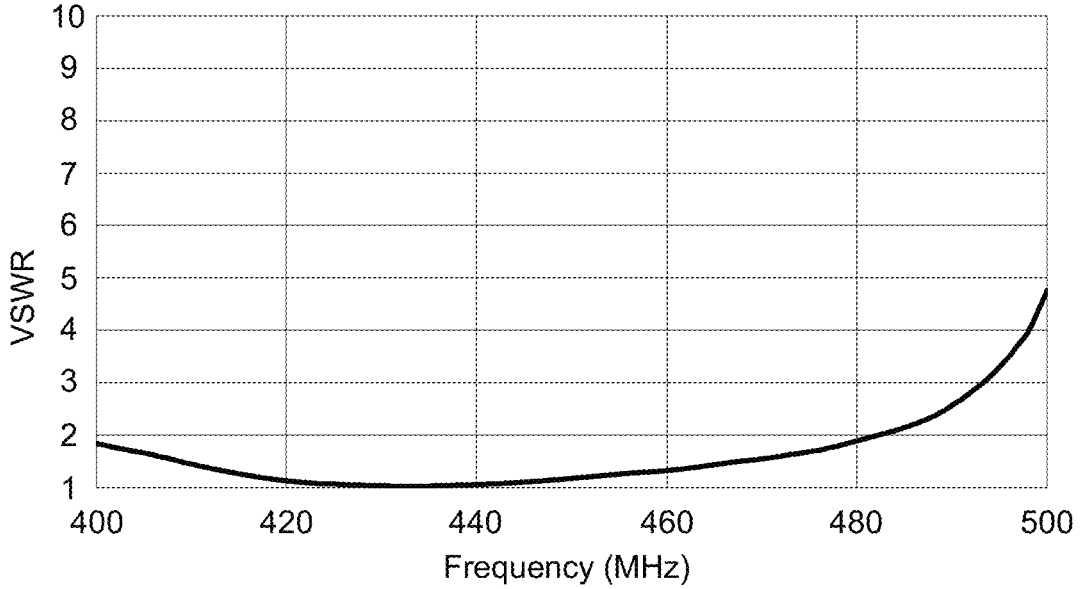
Figure 10C:
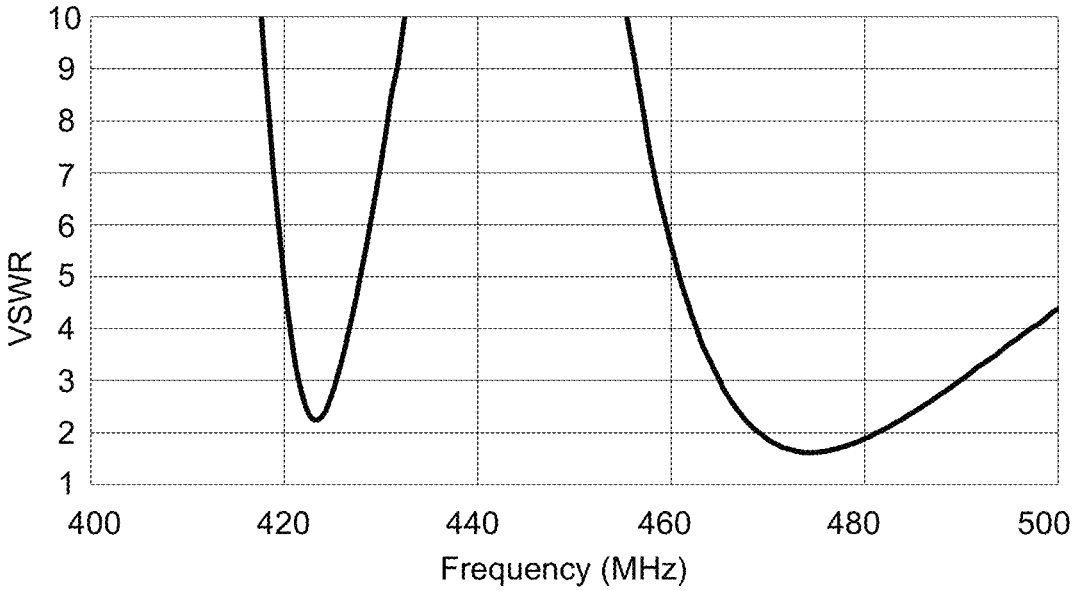

FIG. 10A shows a VSWR graph of GNSS antenna measured at point 409 of board 102. It can be seen that within bandwidth 1150-1280 MHz and 1540-1600 MHz matching is ensured. Here matching means VSWR≤2. FIG. 10B shows a VSWR graph at the input of the UHF antenna (cable 112) when inductors 307A, 307B, 307C, 307D are available. It can be seen that VSWR≤2 is ensured in the bandwidth 400-480 MHz. FIG. 10C shows a VSWR graph at the input of the UHF antenna (cable 112) when inductors 307A, 307B, 307C, 307D are unavailable. In this case, VSWR≤2 is ensured only in a very narrow bandwidth 470-480 MHz.

Having thus described the different embodiments of a system and method, it should be apparent to those skilled in the art that certain advantages of the described method and apparatus have been achieved. It should also be appreciated that various modifications, adaptations, and alternative embodiments thereof may be made within the scope and spirit of the present invention. The invention is further defined by the following claims.

What is claimed is:

1. A GNSS-UHF antenna, comprising:

a first printed circuit board (PCB) having four sets of radiating elements thereon, wherein the first PCB, in a rolled-up state, is oriented vertically, and the four sets of radiating elements form a quadrifilar helical antenna for operating with right-hand circularly polarized signals in a GNSS (Global Navigation Satellite System) frequency band and simultaneously form a part of a monopole antenna for operating with linearly polarized signals in a UHF (ultra-high frequency) frequency band;

wherein the first PCB, in the rolled up state, is approximately square in plan view;

an excitation circuit providing right-hand circular polarization operation of the quadrifilar helical GNSS antenna;

a second shielded PCB below the first PCB, the second shielded PCB including a low noise amplifier (LNA);

a metal plate below the second shielded PCB and offset from the second shielded PCB;

for each set of radiating elements, a corresponding downward-extending conductor connected to the second shielded PCB at a first end and connected to the set of radiating elements at a second end through an inductor;

a first coaxial cable being an output of the GNSS antenna and having its braiding connected to the second shielded PCB and to the metal plate and its central conductor connected to an output of the LNA, wherein the first cable includes a partial loop between the second shielded PCB and the metal plate; and a second coaxial cable being an output of the UHF antenna and having its braiding connected to the metal plate.

2. The antenna of claim 1, wherein the second shielded PCB includes a first shield above the second PCB and a second shield below the second PCB.

3. The antenna of claim 2, wherein the central conductor of the second coaxial cable is connected to the second shielded PCB.

4. The antenna of claim 2, wherein the central conductor of the second coaxial cable is connected to the second shielded PCB through a capacitor.

5. The antenna of claim 1, wherein the excitation circuit is located on a third PCB above the first PCB.

6. The antenna of claim 5, further comprising a third coaxial cable from the second PCB to the excitation circuit on the third PCB.

7. The antenna of claim 6, wherein the third coaxial cable is oriented generally along a vertical axis and its central conductor is connected to the excitation circuit at a first end and to the input of the LNA at its second end, and wherein a braiding of the third coaxial cable is connected to a metallization layer of the third PCB at its first end and to the second shielded PCB at its second end.

8. The antenna of claim 7, wherein the second coaxial cable wraps around a braiding of the third coaxial cable.

9. The antenna of claim 1, wherein the inductor is a discrete inductor.

10. The antenna of claim 1, wherein the inductor is a distributed inductor.

11. The antenna of claim 1, wherein the first PCB is flexible and is flat prior to being rolled up.

12. The antenna of claim 1, wherein each radiating element is shaped as a zig-zag by using four conductors.

13. The antenna of claim 1, wherein each radiating element includes first, second and third conductors arranged into a zig-zag, such that the first and second conductors are connected via a first capacitor at one end, and the first and second conductors are connected via a second capacitor at another end, and wherein the third conductor is located at the top part of the first PCB.

14. The antenna of claim 1, wherein the metal plate located under the third PCB and is galvanically connected to a housing of a surveying receiver or is an integral part of the surveying receiver.

15. The antenna of claim 14, wherein the housing is mounted on a pole such that the housing is offset from the pole by a dielectric.

16. A GNSS-UHF antenna, comprising:

a first printed circuit board (PCB) having four sets of radiating elements thereon, wherein the first PCB, in a rolled-up state, is oriented vertically, and the four sets of radiating elements form a quadrifilar helical antenna for operating with right-hand circularly polarized signals in a GNSS (Global Navigation Satellite System) frequency band and simultaneously form a part of a monopole antenna for operating with linearly polarized signals in a UHF (ultra-high frequency) frequency band;

wherein the first PCB, in the rolled up state, is approximately square in plan view;

an excitation circuit providing right-hand circular polarization operation of the quadrifilar helical GNSS antenna, a second PCB above the first PCB, wherein the excitation circuit is located on the second PCB;

a first metal plate below the first PCB;

a second metal plate below the first metal plate and offset from the first metal plate;

for each set of radiating elements, a corresponding downward-extending conductor connected to the first metal plate at a first end and connected to the set of radiating elements at a second end through an inductor;

a first coaxial cable being an output of the GNSS antenna and having its braiding connected to the first metal plate and to the second metal plate and its central conductor connected to an input of the excitation circuit, wherein the first cable includes a partial loop between the first metal plate and the second metal plate; and a second coaxial cable being an output of the UHF antenna and having its braiding connected to the second metal plate.

17. The antenna of claim 16, wherein the central conductor of the second coaxial cable is connected to the second PCB.

18. The antenna of claim 17, wherein the central conductor of the second coaxial cable is connected to the second PCB through a capacitor.

19. The antenna of claim 16, wherein the first coaxial cable is oriented generally along a vertical axis between the first metal plate and the second metal plate.

20. The antenna of claim 16, wherein the central conductor of the second coaxial cable wraps around a braiding of the first coaxial cable.

* * * * *